US005543029A

United States Patent [19]

Kenmoku et al.

[11] Patent Number: 5,543,029

[45] Date of Patent: Aug. 6, 1996

[54] PROPERTIES OF THE SURFACE OF A TITANIUM ALLOY ENGINE VALVE

[75] Inventors: Takeji Kenmoku, Fujisawa; Shinichi Umino, Yugawara-cho; Eiji Hirai; Kazuyoshi Kurosawa, both of Atsugi; Yoshio Matsumura, Hiratsuka, all of Japan

[73] Assignee: Fuji Oozx Inc., Japan

[21] Appl. No.: 564,930

[22] Filed: Nov. 30, 1995

Related U.S. Application Data

[63] Continuation of Ser. No. 235,549, Apr. 29, 1994, abandoned.

[51] Int. Cl.[6] ..... C25D 15/00

[52] U.S. Cl. ..... 205/109; 205/131; 205/151; 205/181; 205/224

[58] Field of Search ..... 205/109, 176, 205/181, 224, 131, 151; 148/516, 537, 555

[56] References Cited

U.S. PATENT DOCUMENTS

| | | | |
|---|---|---|---|
| 4,122,817 | 10/1978 | Matlock | 123/188.3 |
| 4,902,388 | 2/1990 | Fornwalt | 205/212 |
| 5,078,837 | 1/1992 | Descamp | 205/181 |
| 5,116,430 | 5/1992 | Hirai et al. | 148/518 |

FOREIGN PATENT DOCUMENTS

| | | |
|---|---|---|
| 2-92494 | 4/1990 | Japan . |
| 5-49802 | 7/1993 | Japan . |

*Primary Examiner*—Kathryn Gorgos
*Assistant Examiner*—Brendan Mee
*Attorney, Agent, or Firm*—Poms, Smith, Lande & Rose Professional Corporation

[57] ABSTRACT

There is provided a new method of improving properties of the surface of an internal combustion engine valve made from titanium alloy, which comprises; the steps of (a) forming a surface undercoat layer of nickel on a surface of the engine valve; (b) heating the resulting nickel undercoated valve in vacuum or in an atmosphere of inert gas, at the temperature of 450° C. to 600° C., for one to four hours; (c) forming further a three component coat layer comprising nickel, phosphorus and particles of material selected from the group consisting of silicone carbide, silicone nitride, boron nitride, and the combination thereof, on the surface of the nickel undercoat layer; and (d) heating the resulting coat layer formed on the nickel undercoat layer, at the temperature of 350° C. to 550° C., for one to four hours, so as to make the particles of ceramic material uniformly and homogeneously dispersed in said coat layer.

3 Claims, 2 Drawing Sheets

PROPERTIES OF THE SURFACE OF A TITANIUM ALLOY ENGINE VALVE

This is a continuation of application Ser. No. 08/235,549 filed on Apr. 29, 1994, now abandoned.

FIELD OF THE INVENTION

The present invention relates to a method of improving surface properties of a titanium alloy valve.

DESCRIPTION OF THE PRIOR ART

In a moving valve mechanism, a valve shaft is very quickly and for a very long period, reciprocated in a valve guide, so as to open and close periodically the valve to have the timing of the valve correspond with the revolution rate of the engine. Therefore, the side surface of the valve shaft always slides on the surface of a valve guide, at very high speed, and abrasion load is repeatedly applied on the contact surface of the valve shaft so as to abrade both the surfaces of the valve shaft and the valve guide. Therefore, when the valve is made from titanium or titanium alloy, it can have relatively high thermal resistance and wear resistance.

The term of "titanium alloy" used in this specification includes titanium metal and titanium based alloys. Titanium metal and its alloy have relative high strength, and significant durability, and titanium alloys are both light and strong.

For example, a titanium based alloy containing 6 weight % of Al, and 4 weight % of V has light weight and is a high strength material having higher thermal resistance to the temperature of operating engine, and high tension strength at the high temperature of a typical engine, and has a relative density being 60% of that of steel. Therefore, titanium alloys are commonly used for automobile components, e.g. engine valve material.

While a titanium alloy has higher resistance, higher relative strength and higher thermal resistance, it has relatively lower thermal conductivity and not enough abrasion resistance. Therefore, when a titanium alloy is used for a reciprocating shaft of an engine valve and the like, the requirement for the engine valve such as abrasion resistance and fatigue strength should be improved. On the other hand, an engine valve is abraded and fatigued because of repetition of sliding wears, and repetition of bending stress loading, and most of such loadings are applied on the surface of the valve. Therefore, most of factors to control the life of the engine valve, and to improve the performances of the valve are due to the condition of the surface. There have been a variety of proposals to modify or treat the surface of the titanium alloy valve, by for example, forming specific coat layer on the surface of the titanium alloy in use for an engine valve.

There have been known as a technique for improving the physical properties of the metal surface, two methods; one is a deposition method of a coat layer on the surface of a metal member so as to impart protection, and the other is a method of forming a new coat layer different in its properties from those of the base matrix. As the former method, there are known processes such as deposition in vacuum, sputtering technique such as physical deposition (physical vapor deposition), and chemical deposition (Chemical vapor deposition). In the latter method, there is known a laser processing of metal surface and plasma processing.

Whereas those techniques are applied to a titanium alloy engine valve, all of the requirements, i.e., productivity of coat layer, adherence strength to bind a coat layer to an engine valve, improvement of abrasion resistance, cost performance, all necessary for manufacture of an engine valve can not be satisfied at the same time. Particularly, it is difficult to achieve a manufacturable coat layer and to contain the cost therefor.

A variety of plating techniques have been used for improving the surface properties of metal engine members. However, where a titanium alloy valve is plated so as to improve the abrasion resistance, the performances of the resulting valve are dependent on a pretreatment, and post treatment of the surface thereof, the composition of the plating bath, and the operation conditions for plating. Therefore, it is very difficult to produce the valve to satisfy the requirements for an automobile engine, and then to select appropriate plating conditions.

When a coat layer to improve abrasion resistance is formed on the surface of the titanium alloy valve by using those prior art processes it is necessary to select an appropriate material to satisfy the requirements for the coat layer. However, there is no method of making such appropriate coat layer to satisfy such a requirement.

U.S. Pat. No. 4,122,817 discloses an engine valve having a contact surface formed of an alloy which exhibits wear-resistant properties, PbO corrosion resistance and oxidation resistance, and the alloy containing carbon 1.4 to 2.0 wt. %, molybdenum 4.0 to 6.0 wt. %, silicon 0.1 to 1.0 wt. %, nickel 8 to 13 wt. %, chromium 20 to 26 wt. %, manganese 0 to 3.0 wt. % with balance being iron.

Japanese (Unexamined) Patent Laid-open application No. 2-92494/1990 proposed an iron-based alloy powder in use for a material to be coated on a face of an engine valve, which comprises C; 1.0 to 2.5 wt. %, Si; 0.1 to 1.0 wt. %, Mn; 3 to 12 wt. %, Ni; 15 to 25 wt. % Cr; 20 to 30 wt. %, Mo; 5 to 15 wt. %, B; 0.005 to 0.05 wt. %, Al; 0.01 to 0.1 wt. % and O; 0.01 to 0.05 wt. % with balance being Fe and impurities.

Further, Japanese (Unexamined) Patent Laid-open application No. 5-49802/1993 proposed an engine valve having an alloy layer comprising Cr 10 to 60 wt. %, C 1 to 8 wt. %, total content of Mo, Ni, W, B, Si and Co; 5 to 20 wt. % with balance being iron, on a facing surface thereof, which is based on an austenite steel.

But much stress and bending force must be loaded periodically and repeatedly on the contact surface of the valve shaft to which the guide slides in contact. As a result, stress is caused within a valve shaft.

SUMMARY OF THE INVENTION

It is an object of the present invention to provide a method of improving abrasion resistance of the coat layer formed on the surface of a valve, to satisfy important requirements for a titanium alloy engine valve, i.e. adherence strength of the coat layer, the production of the coat layer formation, the cost thereof.

The further objects of the present invention will be understood from the following description.

DETAILED DESCRIPTION OF PREFERRED EMBODIMENTS

Figure 1:
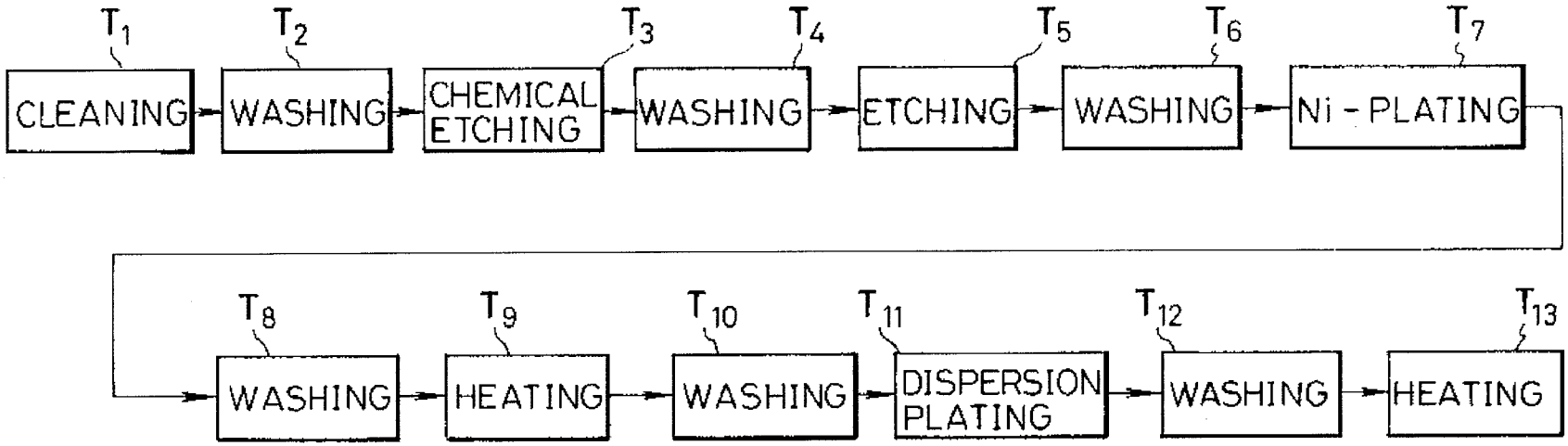
FIG. 1 is a flow sheet in accordance with a method of the present invention.

In general, while a metal member will be degraded by various reaction such as abrasion, corrosion and oxidation, most of such reactions are caused on the surface thereof. An engine valve is not an exception thereof.

Therefore, there have been many proposed and/or developed methods of improving the physical properties of the surface thereof, as described before. Particularly, ceramic coating techniques have been developed so as to improve abrasion resistance and thermal resistance of metal materials. The inventors of this invention have developed a method of improving the surface properties of the valve, to satisfy requirements for an engine valve, in regard to production of the coat surface layer, binding strength between the coat layer and the valve, improvement of abrasion resistance and the cost of manufacture.

As a result, the inventors have developed a method of improving the abrasion resistance of the surface of the valve by plating Ni—P on the surface of the titanium alloy valve. Further, the inventors have reviewed a variety of the conditions so as to select appropriate conditions for plating. An undercoat layer of nickel is formed by plating on the surface of the valve before plating Ni—P layer, and then, the coat layer adhered on the nickel undercoat layer is heated at a specific temperature and for a specific period, so as to disperse ceramic particles uniformly and homogeneously in the Ni—P metal matrix of the coat layer. Then, the inventors have found that some improvement of abrasion resistance of the valve can be attained under appropriate conditions for plating and heating procedures.

The improvement of the surface performance of an internal combustion engine valve made from titanium alloy can be attained by forming as a surface undercoat a nickel layer directly on a surface of the engine valve by plating, and then heating the resulting nickel undercoat at a specific condition, and further, forming as a top coat a three component coat layer comprising nickel, phosphorus and ceramic particles by plating.

Further, the inventors have reviewed the relationship between hardness and strength (rotation bending fatigue strength) of the top coat formed on the surface of the titanium alloy valve and further the relationship of the abrasion resistance with the hardness of the top coat.

The ceramic particulate material to be uniformly dispersed within the three component coat in accordance with the present invention comprises material selected from the group consisting of silicon carbide (SiC), boron nitride (BN), silicon nitride ($Si_3N_4$), and the combination thereof. Such particulate material can be finely and uniformly dispersed in the coat layer to produce necessary hardness thereof.

Such ceramic materials silicon carbide (SiC), boron nitride (BN), silicon nitride ($Si_3N_4$), as used in accordance with the present invention have an expanded utility in the application to a machine component, and an automobile component. Particularly, SiC and $Si_3N_4$ have been developed to be utilized in thin layer, coating and amorphous material in its application.

The properties of silicon carbide (SiC) and silicon nitride ($Si_3N_4$) are shown in Table 1. It is apparent from this table that those ceramic materials can be used to form the coating of the valve.

TABLE 1

| | SiC | $Si_3N_4$ |
|---|---|---|
| Apparent density | 2.3–3.34 | 2–2.3 |
| Bending strength (kg/mm$^2$) | 6–95 | 5–500 |
| Fracture toughness(MN/m$^{3/2}$) | 2.4–5.6 | 1–9 |
| Thermal shock resistance Δ T(°C.) | 200–700 | 400–900 |
| Hardness(Vickers: kg/mm$^2$) | 1,800–3,700 | 1,100–1,900 |

Table 1 indicates that the $Si_{3\ N4}$ is good at bending strength, fracture strength and abrasion resistance in comparison with SiC.

In accordance with one view of the present invention, mere such ceramic material is not used to form a coat layer, and the ceramic material is combined with a metal matrix comprising nickel-phosphorus, and the particles of the ceramic material are homogeneously dispersed within the metal matrix, so as to produce synergistic effect which cannot be obtained merely by metal material.

The function of the particulate material is based on its higher strength; physical properties. Therefore, such ceramic particulate material as SiC and $Si_3N_4$ can be used merely or in combination.

The term "component" used for indicating "unit" constituting the coat layer to be formed on the surface of an engine valve means each component of nickel, phosphorus and particles of ceramic material; three components. Therefore, the fine particles of the ceramic material may be "SiC", "BN", "$Si_3N_4$" and the combination thereof.

The composition of the three component coat layers to be formed as an outer coat on the surface of the titanium alloy valve in accordance with the present invention may include Ni—P—SiC, Ni—P—BN, Ni—P—$Si_3N_4$, Ni—P—(SiC+BN), Ni—P—(SiC+$Si_3N_4$), Ni—P—(SiC+$Si_3N_4$) and Ni—P—( SiC+BN+$Si_3N_4$).

The factors to control the performance or feature of the three component coating to be formed as an outer coat on the surface of the titanium alloy valve may be the content of ceramic particulate material, size and size distribution of the ceramic particles, shape of the particles, and interfacial stability between the particles and metal matrix. Therefore, such factors should be selected in view of desired abrasion resistance of the three component coat layer comprising Ni—P-dispersed ceramic fine particles to be finally formed on the surface of the valve in accordance with the present invention.

The size of the ceramic particles to be dispersed in the coat layer is preferably below ten and several micrometers, and more preferably 1 to 5 micrometers. When the size is below one micrometer, and then the particles are very finely divided, the abrasion resistance improvement can not be expected too much.

One of SiC, BN and $Si_3N_4$ can be used, or the combination of two or more selected from SiC, BN and $Si_3N_4$. Further, the size of the particles can be the same, or the different sizes of the particles can be used and further, the size distribution to get closest packing can be used.

The content of the particular material based on the weight of the coat layer is preferably 2 to 10% and more preferably 2 to 7%.

The thickness of the three component coat layer comprising Ni—P-fine particles of ceramic material to be formed on the titanium alloy valve is preferably 10 to 30 micrometers. This thickness should be selected optionally in view of desired hardness of the coat layer, the cost of the preparation of the coat layer, and the production thereof.

FIG. 1 shows a flow sheet of the process of improving a surface performance of the valve in accordance with a method of the present invention.

In FIG. 1, the steps $T_1$ to $T_{13}$ represent each step for a plating process, and the steps of $T_1$ to $T_6$ are for preliminary procedures before Ni plating for production of an undercoat layer, and the steps of $T_8$ to $T_{10}$ are for the post treatments after Ni plating, and then, the steps of $T_{12}$ to $T_{13}$ are for the post treatments of plating to form as a top coat a three component layer of Ni—P-dispersed ceramic particles.

The preliminary treatment for plating is an essential step necessary for the plating, and then the 80% of the number badness is due to bad preliminary treatment. Therefore, the preliminary treatment should be carefully carried out.

The engine valve as available from the factory is as immersed in an oil, and a lot of oil or grease remains on the surface of the engine valve. The step $T_1$ of cleaning the valve should remove completely oil and grease from the valve, by a conventional process such as a steam defatting process, or treatment with alkali solution.

An alkali defatting solution to be used in the step $T_1$ may comprise the composition as shown in Table 2, to remove oil and grease remaining on the surface of the sample.

TABLE 2

| Alkali material | g/l |
|---|---|
| sodium triphosphate ($Na_3PO_4$) | 20 |
| sodium orthosilicate ($Na_4SiO_4$) | 20 |
| non-ionic surfactant | 0.5 to 2 |
| Temperature of solution | 60 to 70° C. |

After defatting by immersion at the step of $T_1$, the sample may be further defatted by electrolysis, so as to remove completely powder and oil remaining in finely irregulated surface which have not removed even by immersion defatting step, and so as to remove completely stains remaining on the surface.

After washing with water at the step of $T_1$, the sample is chemically treated at the step of $T_2$ by dipping in a chemical bath comprising the solution as shown in the following table, at room temperature until the bath generates red bubbles. This chemically etching step is to remove a thin and tough oxide coat formed on the surface of the sample, so as to activate the surface. The preferable solution composition and condition for the chemical etching are as follows.

Composition of chemical etching solution and condition thereof:

TABLE 3

| Components | Ratio |
|---|---|
| 60 wt % hydrogen fluoride | one volume |
| 60 wt % nitrate | three volume |
| Temperature of solution | room temperature |

After chemically etching, the sample is washed with water at the step of $T_3$, and then is dipped in an etching bath comprising the composition as shown in Table 4, at the step of $T_5$ so as to remove a worked strained surface layer from the sample so as to expose a fresh and strainless crystal surface of the titanium alloy. The composition of the etching solution and the condition to be used in the step of $T_3$ are as follows.

Composition of etching bath and the condition thereof;

TABLE 4

| Components | Amount |
|---|---|
| sodium dichromate | 250 to 390 g/l |
| 60 wt % hydrogen fluoride | 25 to 48 ml/l |
| Temperature of solution | 82 to 100° C. |

After etching step of $T_5$, the sample is washed with water, and further, plated with nickel at the step of $T_7$. The object of Ni-plating at the step of $T_7$ is to form an undercoat for improving adhesion strength with a top coat.

As a Ni ion source, nickel sulfate, nickel chloride or nickel sulfamate can be used. The costs thereof are in the order of nickel sulfate, nickel chloride and nickel sulfamate, and the solubility thereof are in the same order too.

$NiCl_2.6H_2O$ is preferable for an anode dissolving agent. The nickel plating can be operated at pH range of 3.0 to 6.2. A buffer solution is necessary for maintaining pH at this range. Boric acid ($H_3BO_3$) solution is preferable for this method, but the other agent such as nickel formate and nickel acetate can be used for pH buffering.

When the pH of nickel plating bath is decreased, the current density is increased, and the electroconductivity is increased so as to improve uniformity of electrodeposition, but the current efficiency is decreased. The temperature of the bath is higher, the higher the current density is, and the lower the voltage is, so as to reduce the hardness of the deposit thereby increasing the flexibility of the coat layer.

The resulting sample is nickel plated at the step of $T_7$, by using a nickel plating bath containing nickel sulfamate, and having the composition as shown in Table 5, under the condition as shown in the lower portion of Table 5.

TABLE 5

| Components | Watt's bath | Sulfamic bath |
|---|---|---|
| nickel sulfate ($NiSO_4.6H_2O$) | 220–380 g/l | |
| nickel chloride ($NiCl_2.6H_2O$) | 30–60 g/l | 0–30 g/l |
| nickel sulfamate ($Ni(NH_2SO_3)_2$) | | 300–800 g/l |
| boric acid ($H_3BO_3$) | 30–40 g/l | 30 g/l |
| additives | appropriate | appropriate |
| pH | 3.0–4.8 | 3.5–4.5 |
| bath temperature | 40–65° C. | 25–70° C. |
| cathode current density ($A/dm^2$) | 2–10 | 2–15 |
| agitation | bubbling | doing |

The thickness of nickel plated layer as in the step $T_7$ is at least 1 micrometers, and preferably ranges 10 micrometer to 30 micrometers.

After finishing nickel plating in the step $T_7$, the sample is washed with water, and then, heated at the step $T_9$. The thermal treatment is one of the important keys of the present invention, and is to form a metal binding between the titanium alloy and Ni-plated undercoat, so as to improve adhesion strength of the both layers. The thermal treatment is carried out at the temperature of 400° C. to 550° C. in an inert gas or in vacuum, for one to four hours. The most preferable condition of the thermal treatment is in a vacuum, at the temperature of 450° C. to 500° C., and for one hour.

Dispersion coat plating:

After thermal treatment at the step of $T_9$ and washing with water, the dispersion plating is carried out at the step of $T_{11}$. This is one of the important keys of the present invention.

The purpose of the dispersion plating is to form as a top coat a three component layer of Ni—P matrix containing uniformly dispersed fine ceramic particles, in order to improve abrasion resistance and thermal resistance of the top coat layer.

The features of the dispersion plating at the step of $T_{11}$ resides in that while the phosphorus source and the ceramic fine particles being difficult to dissolve are uniformly dispersed, metal matrix of Ni—P is deposited together with the deposition of fine ceramic particles, so that the three component layer of the metal matrix containing uniformly dispersed ceramic particles is deposited or formed.

The combination of Ni—P metal matrix and fine particles enables a synergistic effect which can not be obtained merely by one component coat layer. Such synergistic function is one of the features of the dispersion plating in accordance with the present invention.

The plating bath and ceramic particles to be used in the step of $T_1$ will be explained.

One example of the plating bath to be used in the step of $T_{11}$ may be a Watt's bath and sulfamic bath containing as a phosphorus source 1 to 10 g/l of sodium hypophosphite. The deposit of Ni—P formed by plating from the plating bath containing a phosphorus source is used as a matrix for dispersing ceramic fine particles.

The dispersion plating in the step of $T_{11}$ is carried out in a plating suspension bath containing uniformly dispersed fine ceramic particles. Therefore, the bath should be agitated continuously so as to avoid precipitation. At the same time, uniform deposition should be carried out. In view of those points, the size of the dispersed particles is preferably below ten and several micrometers, and more preferably 1 to 5 micrometers. When the size of the particles is below one micrometer, it is too small to get abrasion resistance. The improvement of the abrasion resistance can not be expected too much.

The thickness of the dispersion plated coat layer formed in the step of $T_{11}$ can be adjusted to the range of 300 to 500 micrometers by selecting the plating bath composition and the plating conditions. However, in view of the requirements such as the necessary improvement of abrasion resistance and the reduction of the cost of the coat layer production, the thickness of the coat layer should be about 10 to 30 micrometers.

Thermal treatment:

After dispersion plating at the step of $T_{11}$, the thermal treatment in the step of $T_{13}$ is carried out after washing with water. The dispersion plating produces a three component layer having a metal matrix of Ni—P, and dispersion phase of SiC, $Si_3N_4$ or BN or the combination thereof. Then, the three component layer is treated thermally so as to harden, thereby improving an abrasion resistance thereof.

Thermal treatment is carried out at the temperature of 350° C. to 550° C. preferably 400° to 550° C., for the period of one to four hours. The most preferable condition is that the temperature is 450° to 500° C., and the period is about one hour.

The condition for the thermal treatment is one of keys of the present inventive method. While the reaction mechanism and the reason are clear, the hardness increases to Hv=800 when the three component layer is heated at 300° to 350° C., but the fatigue limit decreases extremely to 100 MPa, but when the layer is heated at 400° to 550° C. for one to four hours, the fatigue limit of the coat layer is recovered to 200 MPa, and the abrasion resistance is sufficiently high.

The fatigue limit of the coat layer containing dispersed particles can be 350 MPa at maximum. The reduction of the strength can be avoided in such coat layer. Therefore, it is understood that the hardness and the fatigue limit of the three component coat layer containing Ni—P-fine ceramic particles are dependent highly on the temperature at which the coat layer is treated.

Accordingly, the inventive method can produce a titanium alloy engine valve with improved surface performance, having a three component coat layer of nickel, phosphorus and dispersed ceramic particles of boron nitride, silicon nitride or silicon carbide or the combination thereof, which is formed directly on the undercoat of nickel which is directly on the surface of the titanium alloy valve.

The present invention is further illustrated by the following examples to show the method of improvement of a valve shaft in accordance with the present invention, but should not be interpreted for the limitation of the invention.

EXAMPLE 1

Used Engine Valve.

Figure 2:
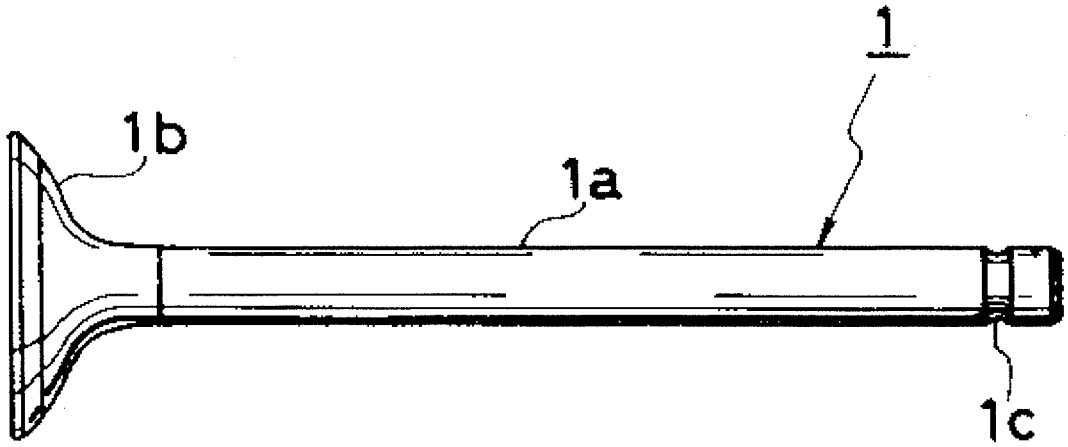
FIG. 2 shows schematically a side view of a titanium alloy valve to which a method of the present invention is applied.

The engine valve 1 made from titanium alloy of Ti-6Al-4 V has a shape as shown in FIG. 2, having a expanded end 1*b* at one end of the valve shaft 1*a* and a groove 1*c* on the whole circumference of the shaft from one end near to the other end of the shaft. The sample was made from titanium alloy of Ti-6Al-4 V, having such shaft shape.

Preliminary Preparation.

The sample was dipped at the temperature of 70° C. for four minutes in an alkali defatting bath comprising the composition as shown in Table 6, so as to remove oil and grease attached on the surface of the sample.

TABLE 6

| Alkali material | g/l |
|---|---|
| sodium triphosphate ($Na_3PO_4$) | 20 |
| sodium orthosilicate ($Na_4SiO_4$) | 20 |
| non-ionic surfactant | 1 |

After being washed with water, the sample was dipped in a chemical bath comprising the components as shown in the following table, for three minutes at room temperature until the bath generates red bubbles.

TABLE 7

| Components | Ratio |
|---|---|
| 60 wt % hydrogen fluoride | one volume |
| 69 wt % nitrate | three volume |

After being washed with water, the sample was dipped in an etching bath comprising the composition as shown in Table 8, at the temperature of 90° C. for ten seconds so as to accomplish defatting from the sample, and then, washing with water.

TABLE 8

| Components | Amount |
|---|---|
| sodium dichromate | 300 g/l |
| 60 wt % hydrogen fluoride | 30 ml/l |

Undercoat nickel plating

The resulting sample was nickel plated by using a nickel plating bath containing sulfamic nickel and having the composition as shown in Table 9, under the condition as shown in the lower portion of Table 9.

TABLE 9

| Components | Amount |
|---|---|
| $NiCl_2.6H_2O$ | 20 g/l |
| $Ni(NH_2SO_3)_2$ | 800 g/l |
| $H_3BO_3$ | 30 g/l |
| pH | 4.0 |
| bath temperature | 40° C. |
| cathode current density ($A/dm^2$) | 15 |

The formed nickel undercoat layer was measured at its thickness by an electrolysis coating thickness meter, and the measured thick was 10 micrometers.

Thermal treatment

The sample was washed with water after nickel plating, and then, heated at the temperature of 550° C. in a vacuum, for three hours, so as to strengthen the metal binding between the sample and nickel undercoat layer. The hardness of the resulting nickel undercoat layer was measured by a micro Vicker's hardness meter. The measured hardness is Hv 158.

Dispersion plating:

After the above thermal treatment, the sample was washed with water, and then, thereon, was plated by using the composition as shown in Table 10, under the condition as shown in the lower portion of Table 10, so as to produce a plated dispersion coating layer.

TABLE 10

| Components | Amount |
|---|---|
| $NiCl_2.6H_2O$ | 20 g/l |
| $Ni(NH_2SO_3)_2$ | 800 g/l |
| $H_3BO_3$ | 30 g/l |
| sodium hypophosphite | 10 g/l |
| SIC * | 250 g/l |
| pH | 4.0 |
| bath temperature | 40° C. |
| cathode current density ($A/dm^2$) | 15 |

* is available from and manufactured by Onoda Cement company limited; the size thereof is 3 micrometers.

Thermal treatment:

After being washed with water, the sample was heated at 350° C. for one hour, so as to strengthen the metal binding between the undercoat nickel layer and the Ni—P—SiC three component coat layer. The thickness of the formed Ni—P—SiC coating layer was measured by using a fluorescence X ray thickness measurement method, and the measured thickness is 30 micrometer.

The hardness of the three component coating layer was measured by a micro Vicker's hardness meter, the resulting hardness is 644 Hv.

EXAMPLE 2

The particles of SiC was replaced by $Si_3N_4$ particles available from Toshiba Ceramic company limited, being 3 micrometers in size, but the example 1 was repeated except for this replacement, so as to form a Ni—P—$Si_3N_4$ three component coat layer. The thickness of the coat layer was 30 micrometers, and the hardness thereof was 670 Hv.

[Experiment]

The engine valves made in examples 1 and 2 were mounted in an engine and underwent a durability test.

Durability Test Condition:

(1) Engine used for test; 6 cylinder×4 valve, 2000 cc (2) test load; 6400 rpm×4/4 loading, cooling water temperature: 60°–110° C.

(3) test duration period: 200 hours.

Assessment method:

The abrasion amounts after the durability test period at an engine valve shaft and an valve guide made from iron-based sintered alloy comprising 4–5 wt % of Cu, 1.5–2.5 wt % of C, 0.4–0.5 wt % of Sn, 0.1–0.5 wt % of P and remaining Fe, through which the shaft is reciprocated were measured.

The result is shown in Table 11.

TABLE 11

| Abrasion amount (micrometer) | Example 1 (micrometer) | Example 2 (micrometer) |
|---|---|---|
| shaft surface | 1.2 | 0.9 |
| valve guide surface | 2.1 | 1.5 |

Consideration:

The allowance of abrasion of a valve shaft and a valve guide is nominally to be at maximum 50 micrometer. An engine valve made in examples 1 and 2 evidences enough durability. Further, it is evident that the coat layer of Ni—P—$Si_3N_4$ example 2) has a little more durable than the coat layer of Ni—P—SiC (example 1).

The improvement of the surface properties of an engine valve in accordance with the present invention can effect significantly abrasion resistance of the valve to satisfy the important requirement of the valve, such as the cost in manufacture, and productivity in automobile component manufacture. Further, because the undercoat layer of nickel is formed directly on the surface of a valve, and then three component coat layers of nickel, phosphorus and ceramic particles of materials selected from the group consisting of silicon carbide, silicon nitride and boron nitride and the combination thereof is formed and further, thermal treatment of both layers can enable to improve the adherence between both layers, and resistance of the coat layer.

The composition and properties of the coat layer can be easily and readily modified by changing the composition of plating bath, and the plating conditions.

The conventional apparatuses being in the prior art; i.e. a conventional plating apparatus and heating apparatus can be used in a new method of improving the properties of the surface of the engine valve. Therefore, new facilities are not needed, and then the cost of manufacture can be reduced.

The valve shaft produced by a method of the present invention evidences an improved abrasion resistance at the reciprocation shaft of the valve, and the shaft has a hardened surface due to the Ni—P—fine ceramics coating layer which have a Vicker's hardness of 250 to 600 in Hv. The valve shaft produced by a method of the present invention can improve both of the abrasion resistance and fatigue resistance.

We claim:

1. A method of improving properties of the surface of an internal combustion engine valve made from a titanium alloy, which comprises the steps of:

(a) forming a surface undercoat layer of nickel on a surface of the engine valve;

(b) heating the resulting nickel undercoated valve in vacuum or in an atmosphere of inert gas, at a temperature of between 450° C. to 660° C., for one to four hours;

(c) forming further a three component coat layer comprising nickel, phosphorus and ceramic particles selected from the group consisting of silicon carbide, silicon nitride, boron nitride, and the combination thereof, on the surface of the nickel undercoat layer; and (d) heating the resulting coat layer formed on the nickel undercoat layer, at a temperature of between 400° C. to 550° C., for one to four hours, to make the ceramic particles uniformly and homogeneously dispersed in said coat layer.

2. The method of claim 1, wherein said nickel undercoat layer is 10 to 30 micrometers thick.

3. The method of claim 1, wherein the three component coat layer is 10 to 30 micrometers thick.

* * * * *